US012064061B2

(12) United States Patent
Hennawi

(10) Patent No.: US 12,064,061 B2
(45) Date of Patent: Aug. 20, 2024

(54) RETRACTABLE TOWEL APPARATUS

(71) Applicant: Ziad Al Hennawi, Dublin, OH (US)

(72) Inventor: Ziad Al Hennawi, Dublin, OH (US)

( * ) Notice: Subject to any disclaimer, the term of this patent is extended or adjusted under 35 U.S.C. 154(b) by 0 days.

(21) Appl. No.: 18/098,234

(22) Filed: Jan. 18, 2023

(65) Prior Publication Data

US 2023/0277017 A1 Sep. 7, 2023

Related U.S. Application Data

(60) Provisional application No. 63/266,974, filed on Jan. 20, 2022.

(51) Int. Cl.

| | |
|---|---|
| ***A47K 10/10*** | (2006.01) |
| ***A47K 10/12*** | (2006.01) |
| *A47K 10/04* | (2006.01) |
| *A47K 10/14* | (2006.01) |

(52) U.S. Cl.

CPC ..... *A47K 10/10* (2013.01); *A47K 10/12* (2013.01); *A47K 10/04* (2013.01); *A47K 10/14* (2013.01)

(58) Field of Classification Search

CPC ..... A47K 10/10; A47K 10/12; A47K 10/14; A47K 10/08; A47K 10/04; D06F 57/12

See application file for complete search history.

(56) References Cited

U.S. PATENT DOCUMENTS 2,051,241 A * 8/1936 Biggers ..... A47G 7/045 211/88.03
2,480,327 A * 8/1949 Idelsohn ..... A47G 25/32 211/113
3,187,904 A * 6/1965 Kiechle ..... A47G 25/1457 211/118
3,610,426 A * 10/1971 Thomas ..... A47B 61/003 211/117
4,108,084 A * 8/1978 Fink ..... A47B 61/003 108/29
4,120,401 A * 10/1978 Newman ..... A45C 11/16 211/85.2
D277,349 S * 1/1985 Campbell ..... D6/513
4,893,715 A * 1/1990 Papazian ..... A47F 7/24 211/118
4,927,354 A * 5/1990 Sanford ..... F23Q 2/34 206/87
5,135,281 A * 8/1992 Pappalardo ..... A47C 7/66 135/90
5,873,400 A * 2/1999 Faller ..... E04F 10/0655 160/46
5,971,238 A * 10/1999 Malvasi ..... A45F 5/004 242/588.1
5,979,671 A * 11/1999 Pan ..... D06F 57/125 211/117
6,053,129 A * 4/2000 Akre ..... A01K 27/005 119/799

(Continued)

*Primary Examiner* — Devin K Barnett

(74) *Attorney, Agent, or Firm* — Mitchell Law PLLC; Matthew W. Mitchell

(57) ABSTRACT

A retractable towel apparatus is disclosed. The retractable towel apparatus includes a plurality of retractable cord and clip modules, each formed of: a housing configured to house a retractable cord, and a clip, wherein the clip is coupled to the retractable cord. An adjustable bar is coupled to the plurality of retractable cord and clip modules, in some embodiments. Some embodiments include a pivoting portion on the clip coupled to the retractable cord.

7 Claims, 13 Drawing Sheets

FIG. 5

(56) References Cited

U.S. PATENT DOCUMENTS 6,257,469 B1 * 7/2001 Cohn ..... A45F 5/004 206/86
6,327,803 B1 * 12/2001 Ruderman ..... G09F 7/18 40/601
6,467,736 B1 * 10/2002 Chiang ..... A61J 9/0661 248/102
6,499,899 B2 * 12/2002 Sawyer ..... B43K 23/002 401/48
6,582,018 B2 * 6/2003 Tseng ..... A47C 3/0255 297/280
6,840,414 B2 * 1/2005 Ziegler ..... A45F 5/004 248/579
6,854,681 B2 * 2/2005 Kish ..... A45F 5/004 242/380
7,165,688 B2 * 1/2007 Cameron ..... A47G 25/02 242/385.1
7,195,413 B2 * 3/2007 Kremizis ..... A45F 5/004 224/677
D610,849 S * 3/2010 Klein ..... D6/513
7,806,085 B1 * 10/2010 Waddy ..... A01K 15/025 119/702
7,841,467 B2 * 11/2010 Slayton ..... A47B 43/02 206/315.9
8,151,737 B1 * 4/2012 Alonzo ..... A01K 27/003 119/799
D679,121 S * 4/2013 Malone ..... D6/514
8,672,146 B1 * 3/2014 Cole ..... A47B 61/003 211/85.2
8,783,474 B2 * 7/2014 Kuhlman ..... A47K 10/04 211/2
8,870,145 B1 * 10/2014 Carlson ..... A47G 25/02 248/329
8,998,690 B1 * 4/2015 Virag ..... F24F 1/04 62/262
9,596,883 B2 * 3/2017 Ahmet ..... A45F 5/004
D833,168 S * 11/2018 Hussain ..... A47K 10/22 D6/518
10,172,451 B2 * 1/2019 Mahugo-Lopez ... A47B 43/006
10,687,619 B2 * 6/2020 Abramov ..... A47F 7/285
D994,054 S * 8/2023 Xu ..... D21/679
2003/0054924 A1 * 3/2003 Amore ..... A63B 21/4025 482/92
2004/0051018 A1 * 3/2004 Cortes ..... A61B 50/312 248/309.1
2006/0207952 A1 * 9/2006 Timmons ..... A47F 5/0892 211/195
2008/0129091 A1 * 6/2008 Sharapov ..... A47C 7/66 297/184.11
2008/0264884 A1 * 10/2008 Felder ..... B25H 3/00 211/113
2010/0055661 A1 * 3/2010 Hegwood ..... A47B 97/02 434/420
2011/0315090 A1 * 12/2011 Marshall ..... A01K 27/004 119/796
2013/0042818 A1 * 2/2013 Capoano ..... A01K 27/00 119/770
2013/0264300 A1 * 10/2013 Shaffer ..... A47F 5/0006 211/117
2014/0284439 A1 * 9/2014 Biagiotti ..... A47K 10/14 248/206.2
2015/0208613 A1 * 7/2015 Krasilczuk ..... A01K 27/003 119/798
2015/0335150 A1 * 11/2015 Frisby ..... A63H 33/006 211/207
2016/0324133 A1 * 11/2016 Britz ..... A01K 97/00
2016/0363263 A1 * 12/2016 Stockham ..... G09F 7/205
2019/0047499 A1 * 2/2019 Villegas ..... B60R 13/043

* cited by examiner

RETRACTABLE TOWEL APPARATUS

CROSS REFERENCE TO RELATED APPLICATIONS

This application claims the benefit of Provisional Application No. 63/266,974 filed on Jan. 20, 2022 which is hereby incorporated herein by reference.

TECHNICAL FIELD

This disclosure relates to towel hangers or racks, and more particularly to retractable towel apparatus.

BACKGROUND

The statements in this section merely provide background information related to the present disclosure and may not constitute prior art.

A typical bathroom includes a wall-mounted towel bar. Bath towels and hand towels are commonly hung or stored on the towel bar. When used, the user generally will either use the towel while it is hung or remove the towel from the bar before using the towel. In both cases, the user is required to manually hang back the towel or at least adjust the towel to the preferred position back on the towel rack. In the case of some elderly and disable individuals, it may be difficult to reposition the towel back on the bar or reach down and grab it from the floor particularly when these individuals have trouble or are unable to crouch or bend down. Often, and especially in the case of children or an inattentive spouse, the towel is just not returned to the proper, preferred position, which can contribute to an undesirable drying position and/or an untidy bathroom.

Therefore, a need exists for a retractable towel apparatus, which may be configured to retract the towel back into a preferred state after use.

SUMMARY

Retractable towel apparatus is disclosed. The retractable towel apparatus includes a plurality of retractable cord and clip modules, each formed of: a housing configured to house a retractable cord, and a clip, wherein the clip is coupled to the retractable cord. An adjustable bar is coupled to the plurality of retractable cord and clip modules, in some embodiments. Some embodiments include a pivoting portion on the clip coupled to the retractable cord.

Embodiments of the towel apparatus include an adjustable bar configured to support and horizontally adjust positioning of the modules.

This summary is provided merely to introduce certain concepts and not to identify key or essential features of the claimed subject matter.

BRIEF DESCRIPTION OF THE DRAWINGS

One or more embodiments will now be described, by way of example, with reference to the accompanying drawings, in which.

DETAILED DESCRIPTION

Figure 1:
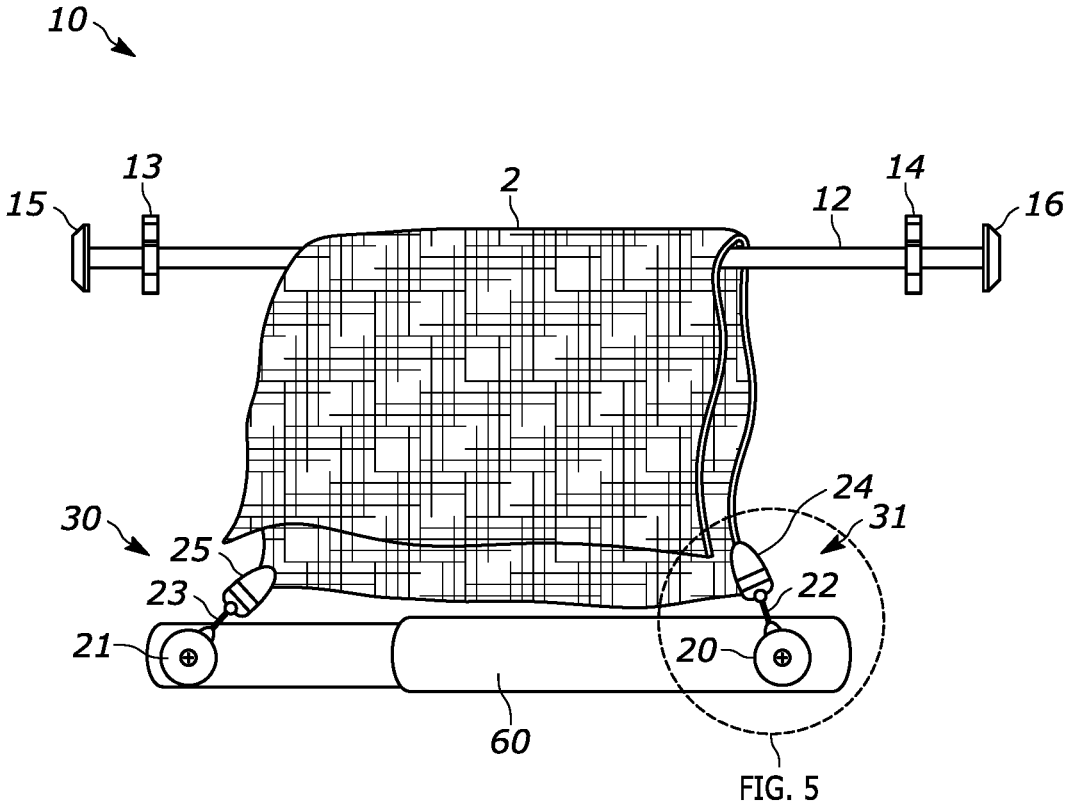
FIG. 1 is a retractable towel apparatus having an adjustable bar depicted in a static position, in accordance with the present disclosure.

Reference throughout this specification to "one embodiment," "an embodiment," or similar language means that a particular feature, structure, or characteristic described in connection with the embodiment is included in at least one embodiment of the subject matter of the present disclosure. Appearances of the phrases "in one embodiment," "in an embodiment," and similar language throughout this specification may, but do not necessarily, all refer to the same embodiment.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

As used in the description herein and throughout the claims, the following terms take the meanings explicitly associated herein, unless the context clearly dictates otherwise: the meaning of "a," "an," and "the" includes plural reference, the meaning of "in" includes "in" and "on." The term "based upon" is not exclusive and allows for being based on additional factors not described, unless the context clearly dictates otherwise. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word exemplary is intended to present concepts in a concrete manner.

Referring now to the drawings, wherein the depictions are for the purpose of illustrating certain exemplary embodiments only and not for the purpose of limiting the same, FIG. 1 shows an exemplary retractable towel apparatus 10 depicted coupled to an exemplary towel 2. The retractable towel apparatus 10 includes at least one retractable cord and clip module such as retractable cord and clip modules 30 and 31 shown. In various embodiments, the retractable towel apparatus 10 includes an adjustable bar 60 configured to horizontally position retractable cord and clip modules 30 and 31 for coupling to a towel 2.

The modules 30 and 31 may be coupled to a surface of the bar 60 or integrated therewith. The bar 60 may be coupled to the wall using one or more techniques including, e.g., mechanical elements, adhesive, hook and loop fasteners, magnets, suction cups, etc. As shown, the adjustable bar 60 is cylindrical-shaped, however it is contemplated herein that many additional shapes may be used including bars with rectangular cross-sectional-shapes.

The adjustable bar 60 is preferably wall mounted below a towel bar 12 such that the clips 24 and 25 can be coupled to a bottom of a towel 2, while the top of the towel 2 can be draped preferably over and around the towel bar 12. In one embodiment, the adjustable bar 60 is a telescoping bar configured for selective length adjustments. In this way, a user may preferentially adjust a length of the bar 60 to accommodate different size towels.

The retractable cord and clip modules 30 and 31 preferably include a housing 20 and 21 configured to retain the retractable cord 22 and 23, and a clip 24 and 25. The housing 20 and 21 preferably contain a biasing element such as a spring to pull in, i.e., retract, the retractable cords 22 and 23 into a wound position.

As FIG. 1 shows, the towel 2 can be draped over a towel bar 12. The exemplary towel bar 12 includes two wall mounting brackets 13 and 14 along with towel bar stops 15 and 16. FIG. 1 is illustrative of a resting or steady-state position of a towel 2 hung over the towel bar 12.

Figure 2:
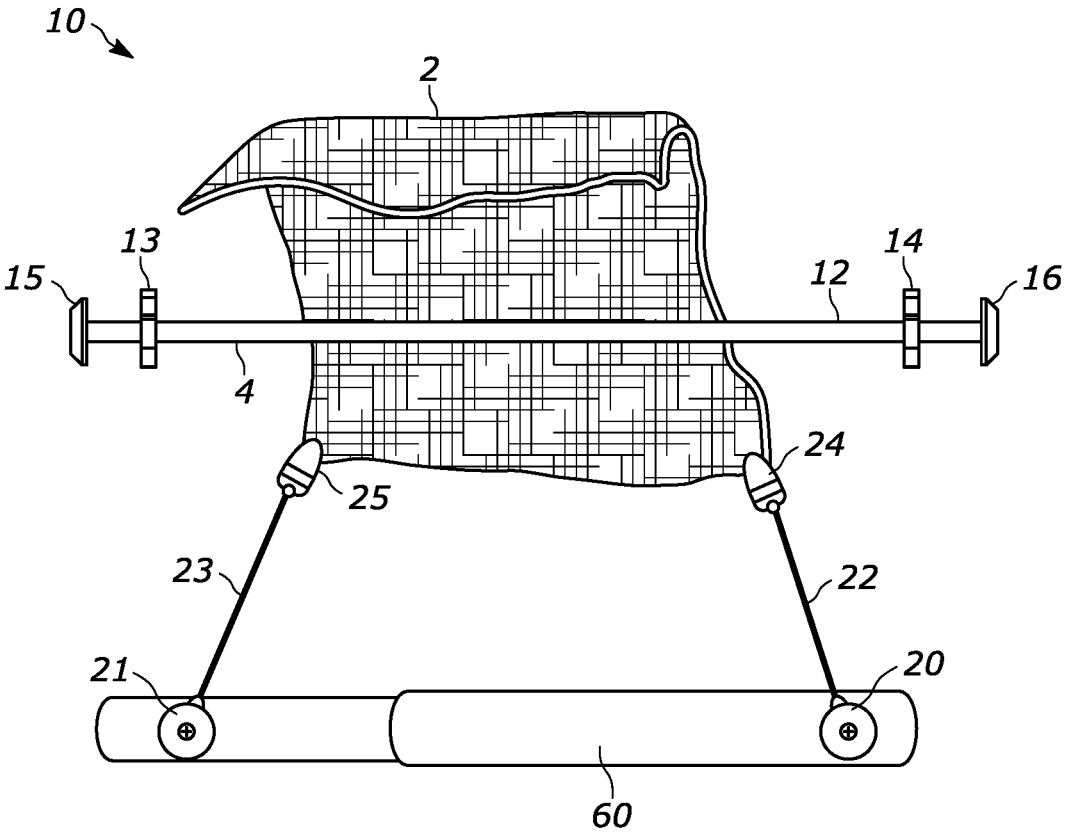
FIG. 2 shows the retractable towel apparatus having an adjustable bar depicted in an exemplary in-use position, in accordance with the present disclosure.

FIG. 2 shows the retractable towel apparatus 10 in an exemplary in-use position. As FIG. 2 shows, a user could pull on the towel 2, thereby extending the retractable cords 22 and 23 from their wound position within the housing 20 and 21, respectively. When done using the towel 2, the user may simply release the towel 2. The biasing element within the housing 20 and 21 then retracts the cords 22 and 23, thereby pulling the towel 2 back into the stored position, such as shown in FIG. 1.

Figure 3:
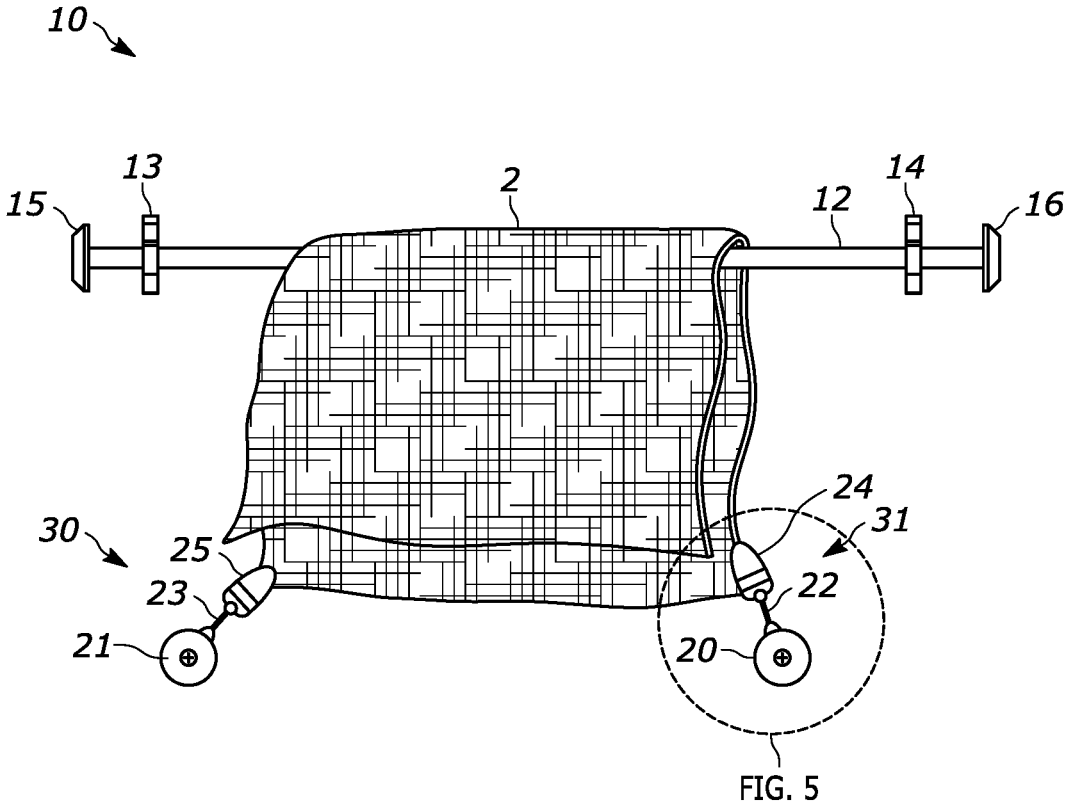
FIG. 3 is a retractable towel apparatus formed of retractable towel apparatus modules depicted in a static position, in accordance with the present disclosure.
Figure 4:
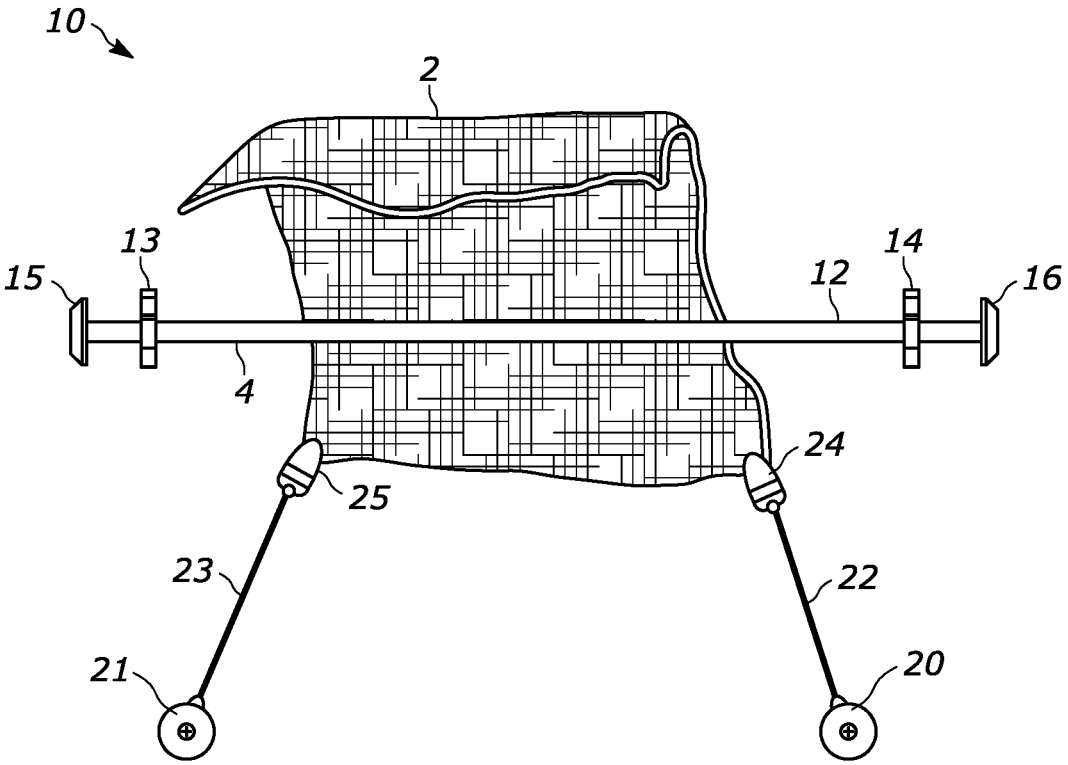
FIG. 4 shows the retractable towel apparatus formed of retractable towel apparatus modules depicted in an exemplary in-use position, in accordance with the present disclosure.

FIGS. 3 and 4 show a further embodiment of the retractable towel apparatus 10 without an adjustable bar. As FIGS. 3 and 4 show, the retractable towel apparatus 10 includes modules 20 and 21. The housing 20 and 21 can be configured for mounting to a wall, such as via mechanical elements. In one embodiment, the housing 20 and 21 is configured to receive a hook or loop fastener and/or layer of adhesive for coupling to the wall having a corresponding hook or loop fastener and adhesive. In one embodiment, the housing 20 and 21 includes an aperture through a center portion from which a mechanical element may pass through and couple to the wall. In one embodiment, the housing 20 and 21 may be coupled to the wall using magnets and adhesive. In one embodiment a suction cup may be used.

Figure 5:
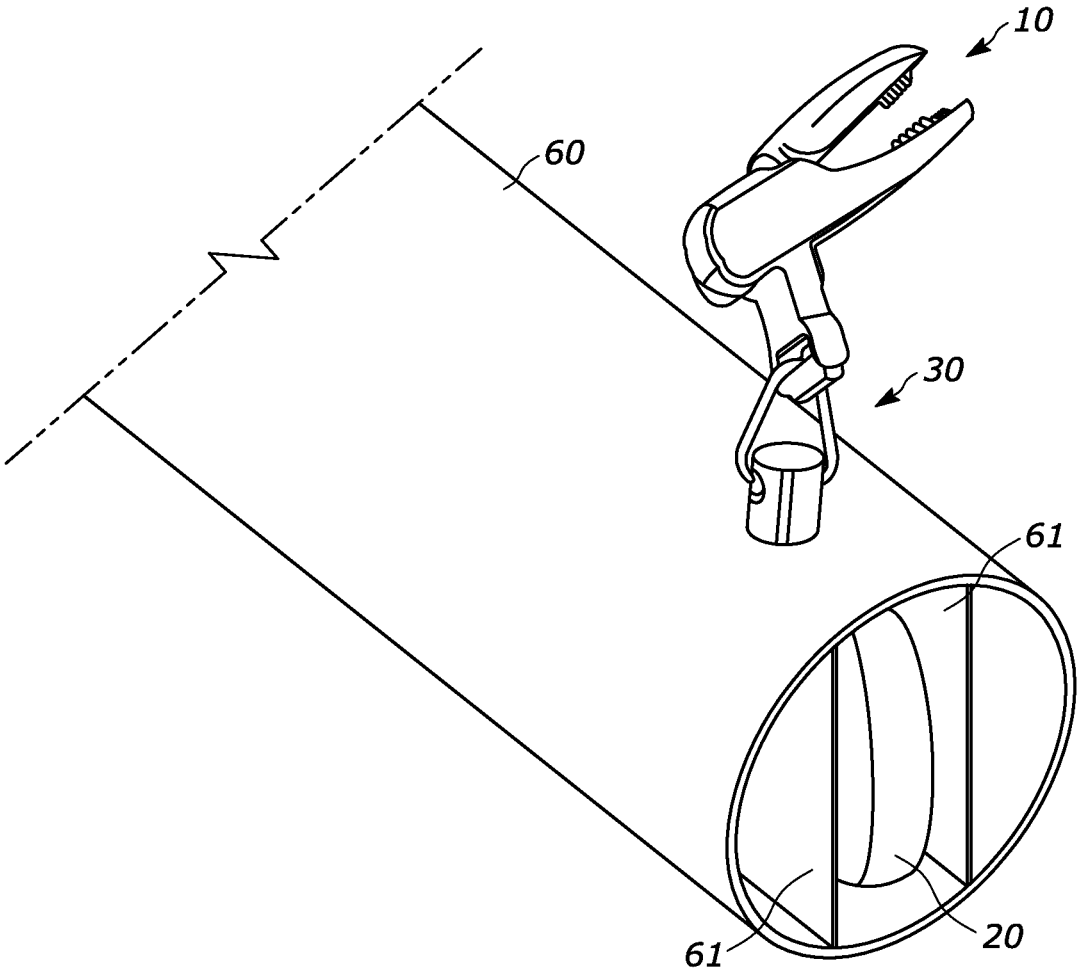
FIG. 5 is a partial view of the apparatus, illustrating the integration of the module partially within the bar, in accordance with the present disclosure.
Figure 6:
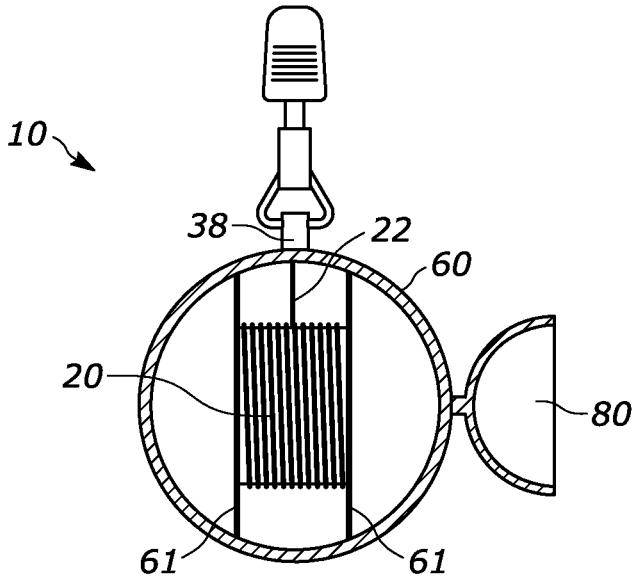
FIG. 6 shows a side view of the apparatus, in accordance with the present disclosure.
Figure 7:
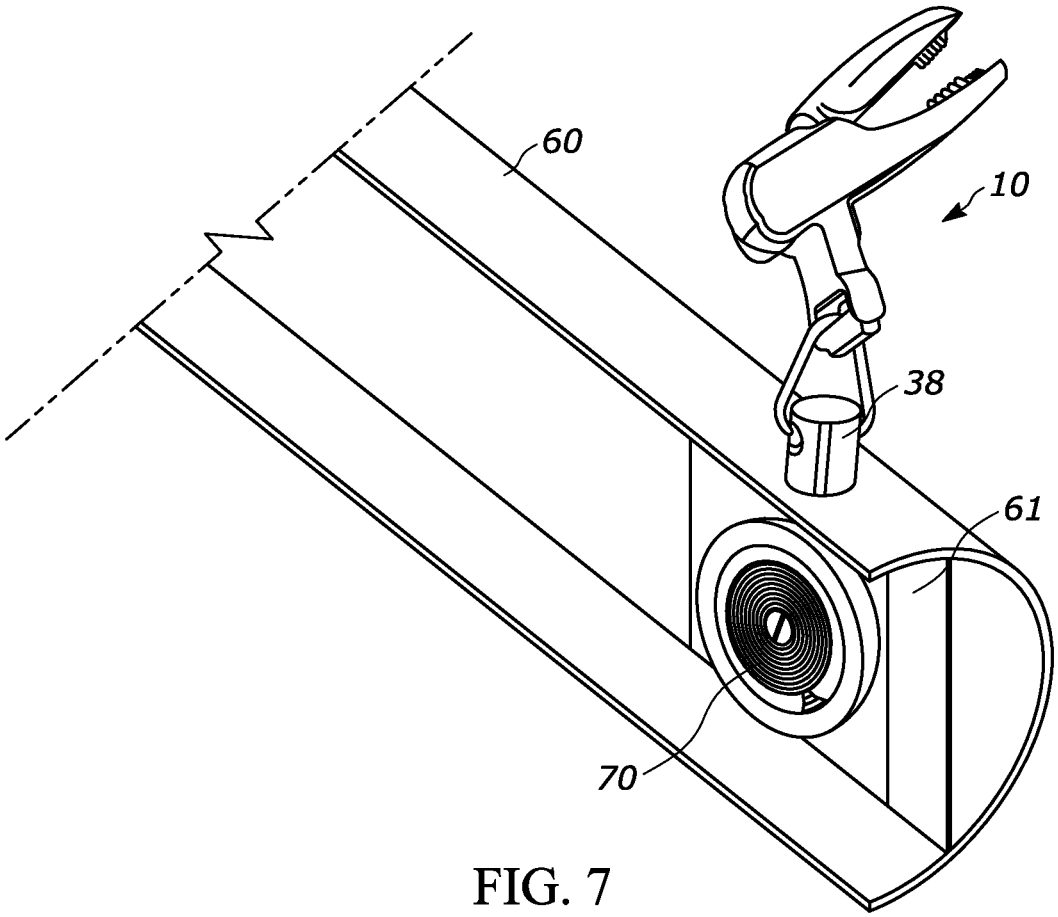
FIG. 7 is a partial view of the apparatus with partial cross-sectional views of the bar and the housing to illustrate integration of the module within the bar, in accordance with the present disclosure.
Figure 12:
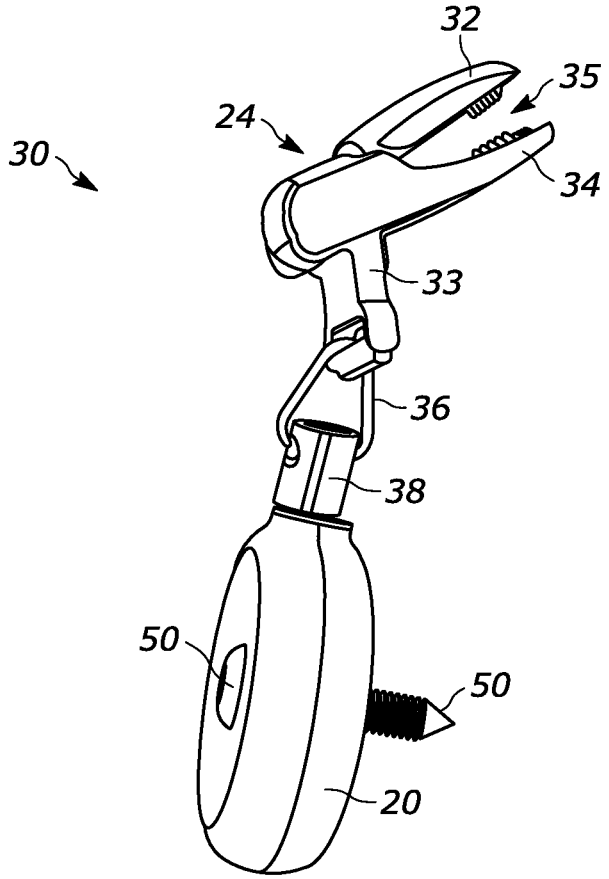
Figure 13:
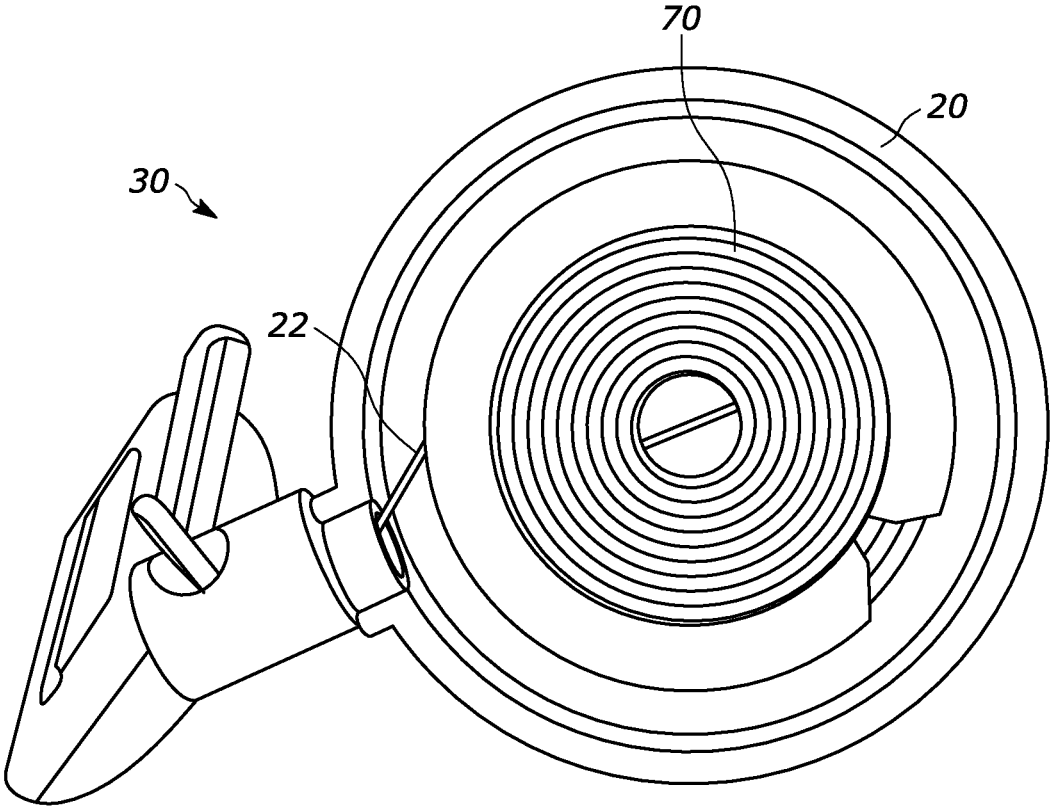
FIG. 13 shows a partial cross-sectional view of the module, illustrating a tension spring within the housing, in accordance with the present disclosure.
Figure 14:
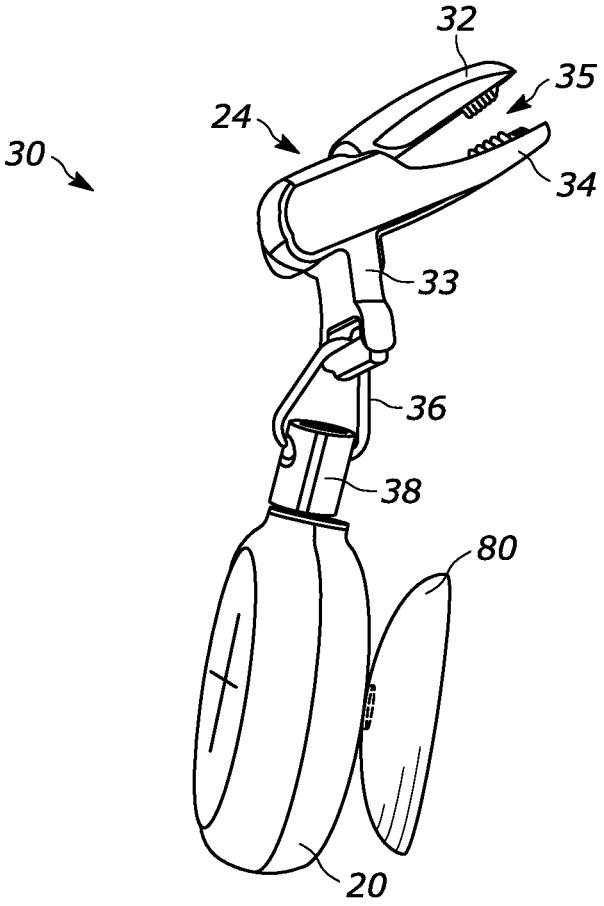
FIG. 14 shows an exemplary embodiment of the module having a suction cup, in accordance with the present disclosure.

FIGS. 5-7 show an embodiment of the retractable towel apparatus 10, integrating the bar 60 with the module 30. As will be apparent, the module 31 may be integrated similarly to the module 30 on an opposing side of the bar 60. FIG. 12 is a partial view of the apparatus 10, illustrating the integration of the module 30 partially within the bar 60. FIG. 13 shows a side view of the apparatus 10. FIG. 14 is a partial view of the apparatus 10 with partial cross-sectional views of the bar 60 and the housing 20 to illustrate integration of the module 30 within the bar 60.

As FIGS. 5-7 show, portions of the module 30 are housed within the bar 60. Supports 61 within the bar may be coupled to the housing 20 of the module 30. In one embodiment, the supports 61 provide rigidity to the bar 60. The cord 22 may pass through an aperture on the bar 60, enabling the cord end connector 38 to function as a stop, e.g., the aperture for the cord 22 has a smaller diameter than the connector 38 so the stop does not pass into an interior of the bar 60.

The housing 20 and 21, clips 24 and 25, and any mechanical coupling elements may be formed of any suitable materials including, plastic, glass, ceramics, metal, or other suitable materials, or a combination of these materials.

The retractable cords 22 and 23 may be formed of a flexible, elastic or inelastic material, including, without limitation, natural or synthetic leather, suede, canvas, cotton, flax, plastic, natural or synthetic rubber, nylon, polyvinyl chloride, polyester, polypropylene, other natural or synthetic fabric or webbing, or any combination thereof.

The adjustable bar 60 may be formed of any suitable materials including, plastic, glass, ceramics, metal, or other suitable materials, or a combination of these materials.

Figure 8:
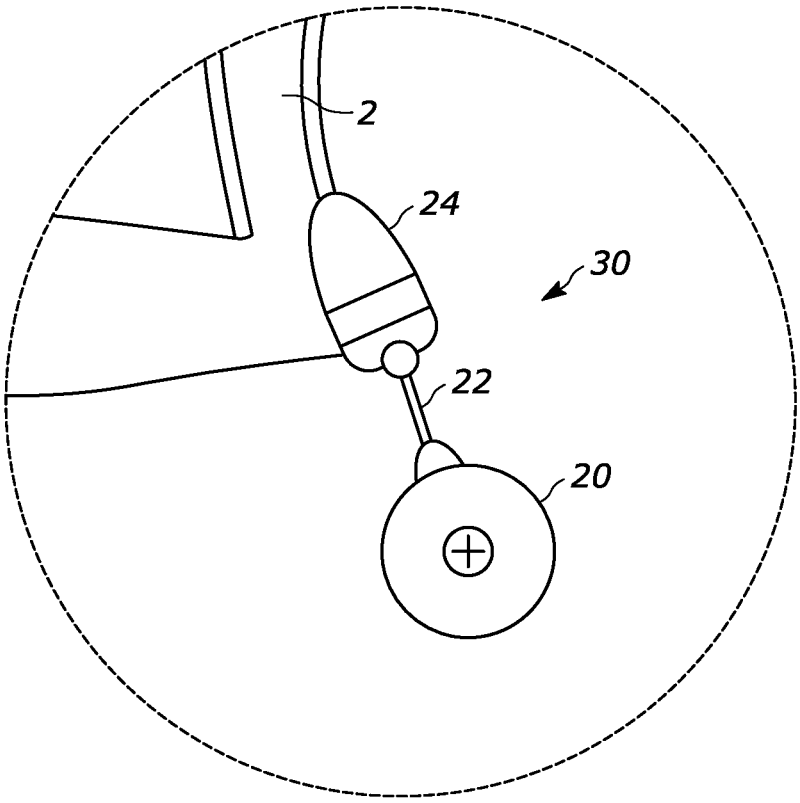
FIG. 8 is an enlarged view of a retractable towel apparatus module, in accordance with the present disclosure.

FIG. 8 shows an exemplary enlarged view of one of the modules 30 coupled to the towel 2 via clip 24. As FIG. 5 shows, the retractable cord 22 is in a stored or wound position, without tension or with negligible tension.

Figure 9:
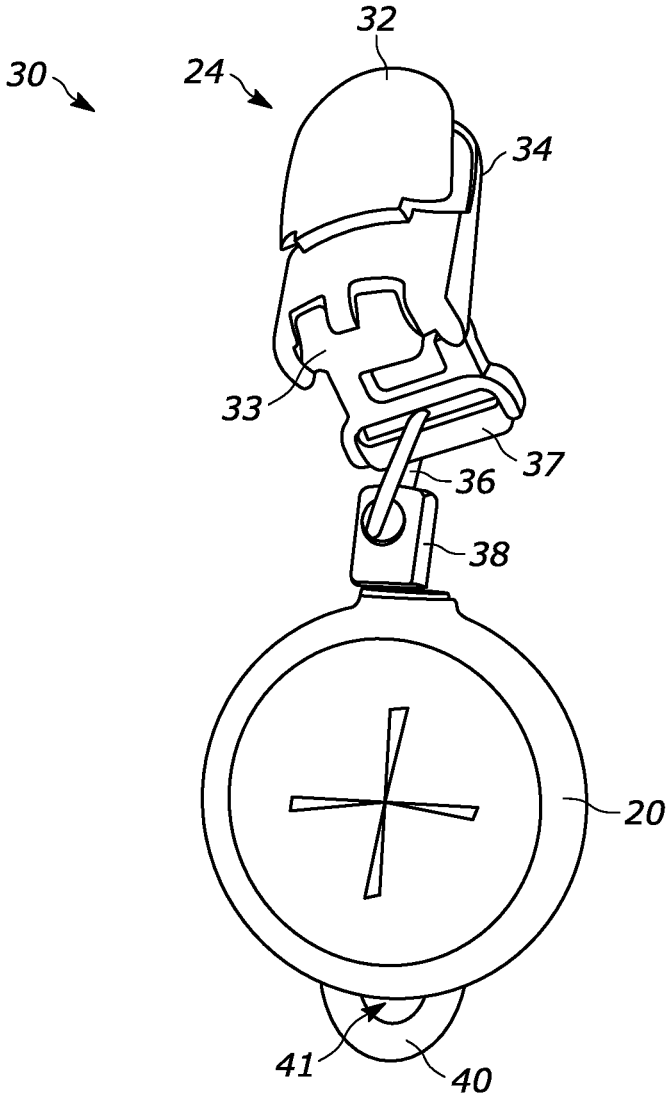
FIGS. 9 and 10 show another embodiment of the retractable towel apparatus module, in accordance with the present disclosure.
Figure 10:
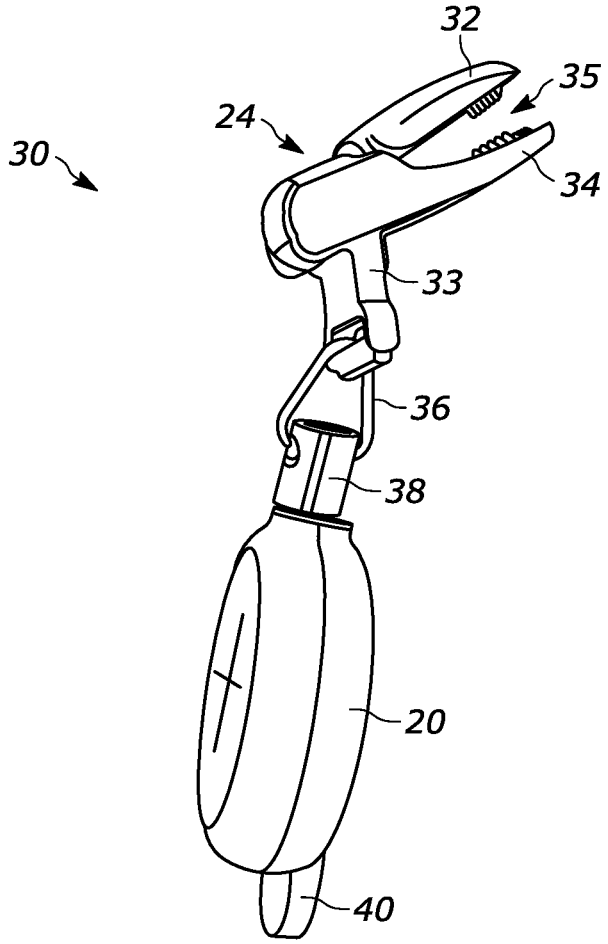

FIGS. 9 and 10 show an embodiment of the retractable cord and clip module 30. In various embodiments, the retractable cord and clip module 31 is the same as module 30. As FIGS. 9 and 10 show, the retractable cord and clip module 30 includes a housing 20 and a clip 24. The housing 20 and the clip 24 are coupled using various exemplary mechanical linkages e.g., a cord end connector 38 and link 36. The retractable cord is connected to the connector 38, which includes an aperture from which the link 36 may pass through.

The housing 20 may include a loop 40 with an aperture 41. The loop 40 may be used to help secure the housing 20 to a wall.

The clip 24, as exemplary, may include a top jaw 32 and a bottom jaw 34. The top and bottom jaws 32 and 34 having an opening or space 35 between them. The top and bottom jaws 32 and 34 are generally closed via a tension spring, as is known in the art for clips. The top and bottom jaws 32 and 34 preferably each include a row of retaining teeth for engaging the towel 2, such as shown in the figures. The clip 24 preferably includes a pivoting bottom portion 33 to aid preferable coupling to the towel 2. In one embodiment, the clip 24 includes an aperture or mechanical connection for coupling directly or indirectly to the retractable cord, such as via a bar 37 form which the link 36 may pass around, thereby coupling the bar 37 and the connector 38.

Figure 11:
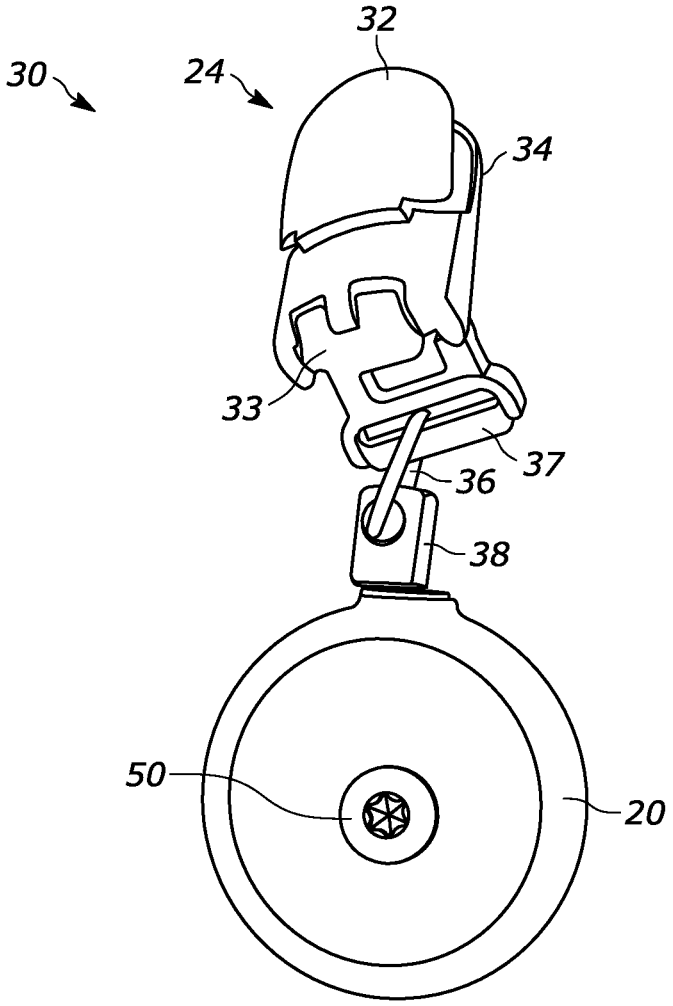
FIGS. 11 and 12 show yet another embodiment of the retractable towel apparatus module, in accordance with the present disclosure.

Referring to FIGS. 11 and 12, in one embodiment, the housing 20 includes an aperture through a center portion from which a mechanical element 50 may pass through. In this way, the housing 20 may be mechanically coupled to the wall. The mechanical element may be a screw or wall anchor, for example.

FIG. 13 shows a partial cross-sectional view of the module 30, illustrating a tension spring 70 within the housing 20. The tension spring 70 is coupled to the retractable cord 22. As the cord 22 is extended from the housing 20, the tension spring 70 will contract in diameter, thereby increasing tension through the cord 22.

FIG. 14 shows an exemplary embodiment of the module 30 having a suction cup 80. The suction cup 80 can be used to coupled the module 30 to a wall or other surface. The suction cup 80 can be formed of silicon or other materials as is known in the art.

Examples in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

While the foregoing disclosure discusses illustrative embodiments, it should be noted that various changes and modifications could be made herein without departing from the scope of the described embodiments as defined by the appended claims. Accordingly, the described embodiments are intended to embrace all such alterations, modifications and variations that fall within scope of the appended claims. Furthermore, although elements of the described embodiments may be described or claimed in the singular, the plural is contemplated unless limitation to the singular is explicitly stated. Additionally, all or a portion of any embodiment may be utilized with all or a portion of any other embodiments, unless stated otherwise.

The invention claimed is:

1. A retractable towel apparatus, comprising:

an adjustable bar; and a plurality of retractable cord and clip modules coupled to the adjustable bar, each formed of:

a housing configured to house a retractable cord; and a clip, wherein the clip includes a pivoting portion and a first jaw and a second jaw, wherein the first jaw is biased against the second jaw via a tension spring, wherein the first and second jaw each include a row of retaining teeth, and wherein the pivoting portion is coupled to the retractable cord; and wherein the retractable cord is connected to a stop, and wherein the housing is coupled to interior support walls, and the adjustable bar includes an aperture for the retractable cord, the aperture having a diameter smaller than a diameter associated with the stop.

2. The retractable towel apparatus of claim 1, wherein the housing is configured to receive one of a hook and loop fastener for attachment to a corresponding hook or loop fastener affixed to a wall.

3. The retractable towel apparatus of claim 1, wherein the housing includes an aperture through a center for receiving a mechanical element.

4. The retractable towel apparatus of claim 3, wherein the mechanical element is a screw or a wall anchor.

5. The retractable towel apparatus of claim 1, wherein the adjustable bar further comprises a plurality of suction cups.

6. A retractable towel apparatus, comprising:

an adjustable bar having interior support walls; and a plurality of retractable cord and clip modules, each formed of:

a housing configured to house a retractable cord, wherein the housing is coupled to the interior support walls; and a clip, wherein the clip includes a pivoting portion, and wherein the pivoting portion is coupled to retractable cord via mechanical elements, wherein the retractable cord is connected to a stop; wherein the clip includes a first jaw and a second jaw, wherein the first jaw is biased against the second jaw using a tension spring, wherein the first and second jaw each include a row of retaining teeth.

7. The retractable towel apparatus of claim 6, wherein the housing is coupled to the interior support walls, and the adjustable bar includes an aperture for the retractable cord, the aperture having a diameter smaller than a diameter associated with the stop.

* * * * *